US009856620B2

(12) United States Patent
Bouchard

(10) Patent No.: US 9,856,620 B2
(45) Date of Patent: Jan. 2, 2018

(54) SHORING SYSTEM USING AT LEAST ONE LIQUID-CONTROLLING SLIDE RAIL

(71) Applicant: GROUPE MAMMUT INC., Calixa-Lavallée (CA)

(72) Inventor: Pierre-Luc Bouchard, Montreal (CA)

(73) Assignee: Groupe Mammut Inc., Calixa-Lavallée, QC (CA)

( * ) Notice: Subject to any disclaimer, the term of this patent is extended or adjusted under 35 U.S.C. 154(b) by 0 days.

(21) Appl. No.: 14/621,801

(22) Filed: Feb. 13, 2015

(65) Prior Publication Data

US 2015/0233078 A1 Aug. 20, 2015

Related U.S. Application Data

(63) Continuation-in-part of application No. 14/180,666, filed on Feb. 14, 2014, now Pat. No. 9,714,496.

(60) Provisional application No. 61/980,529, filed on Apr. 16, 2014.

(51) Int. Cl.

| | |
|---|---|
| ***E02D 5/00*** | (2006.01) |
| ***E02D 19/00*** | (2006.01) |
| ***E02D 3/10*** | (2006.01) |

(52) U.S. Cl.

CPC ..... *E02D 19/00* (2013.01); *E02D 3/10* (2013.01)

(58) Field of Classification Search

USPC ..... 405/39, 43, 45, 114, 272, 282–285

See application file for complete search history.

(56) References Cited

U.S. PATENT DOCUMENTS

| | | | | |
|---|---|---|---|---|
| 3,427,810 | A * | 2/1969 | Petersen | E02B 11/00 405/43 |
| 3,729,938 | A * | 5/1973 | Morrice | E02D 17/08 405/282 |
| 5,388,931 | A | 2/1995 | Carlson | |
| 7,775,746 | B2 * | 8/2010 | Kim | E02D 5/02 405/231 |
| 2004/0170478 | A1 * | 9/2004 | Kadiu | E02D 17/08 405/282 |

(Continued)

FOREIGN PATENT DOCUMENTS

| | | |
|---|---|---|
| CN | 2467575 | * 12/2001 |
| CN | 102912797 | 2/2013 |
| TW | 201207197 | 2/2012 |

OTHER PUBLICATIONS

"Geotechnical Engineering", wikipedia, Jan. 19, 2014.

(Continued)

*Primary Examiner* — Sean D Andrish

(74) *Attorney, Agent, or Firm* — Gowling WLG (Canada); Benoit Yelle

(57) ABSTRACT

A shoring system for controlling liquid on a site comprising a plurality of slide rails and a plurality of lateral plates. The plurality of slide rails comprise at least one liquid-controlling slide rail comprising a hollow body and lateral openings permeable to liquid when the at least one liquid-controlling slide rail is positioned into the ground. The openings are positioned on at least a portion of the liquid-controlling slide rail directed outside of the excavation. Each of the plurality of slide rails comprises at least two plate rails. Each of the plurality of lateral plates can be slid into the plate rails of two adjacent slide rails of the plurality of slide rails.

21 Claims, 15 Drawing Sheets

(56) References Cited

U.S. PATENT DOCUMENTS

2014/0158373 A1* 6/2014 Least ..... E21B 17/046
166/380

OTHER PUBLICATIONS

"Shoring", wikipedia, Jul. 4, 2013.
"Tabulated Data Modular Slide Rail System", Griswold Machine & Engineering (GME), Oct. 18, 2001 retrieved online on Aug. 9, 2017 from http://www.gme-shields.com/wp-content/uploads/2013/08/slide-rail-tab-data-2.pdf.
"Slide Rail Shoring System", Griswold Machine & Engineering (GME), retrieved online on Aug. 9, 2017 from http://www.gme-shields.com/wp-content/uploads/2013/04/2015-GME-Slide-Rail.pdf.
"Slide Rail Shoring Systems", Pro-Tec Equipment, retrieved online on Aug. 9, 2017 from https://s3.amazonaws.com/protec-assets/pdfs/Pro-Tec_Equipment_Slide_Rail_No_Dealer_Back.pdf?mtime=20140227104929.
"Single Slide Rail RS Series 790", SBH Tiefbautechnik, retrieved online on Aug. 9, 2017 from https://www.sbh-shoring.com/fileadmin/user upload/Downloads/Prospekte/Dokumente/eng/single_slide_rail/instruction_790-2008.pdf.
"Slide Rail Installation", Griswold Machine & Engineering (GME), instructional video found online on Jun. 20, 2017 at https://www.youtube.com/watch?v=iv8WI1kJrwU.

* cited by examiner

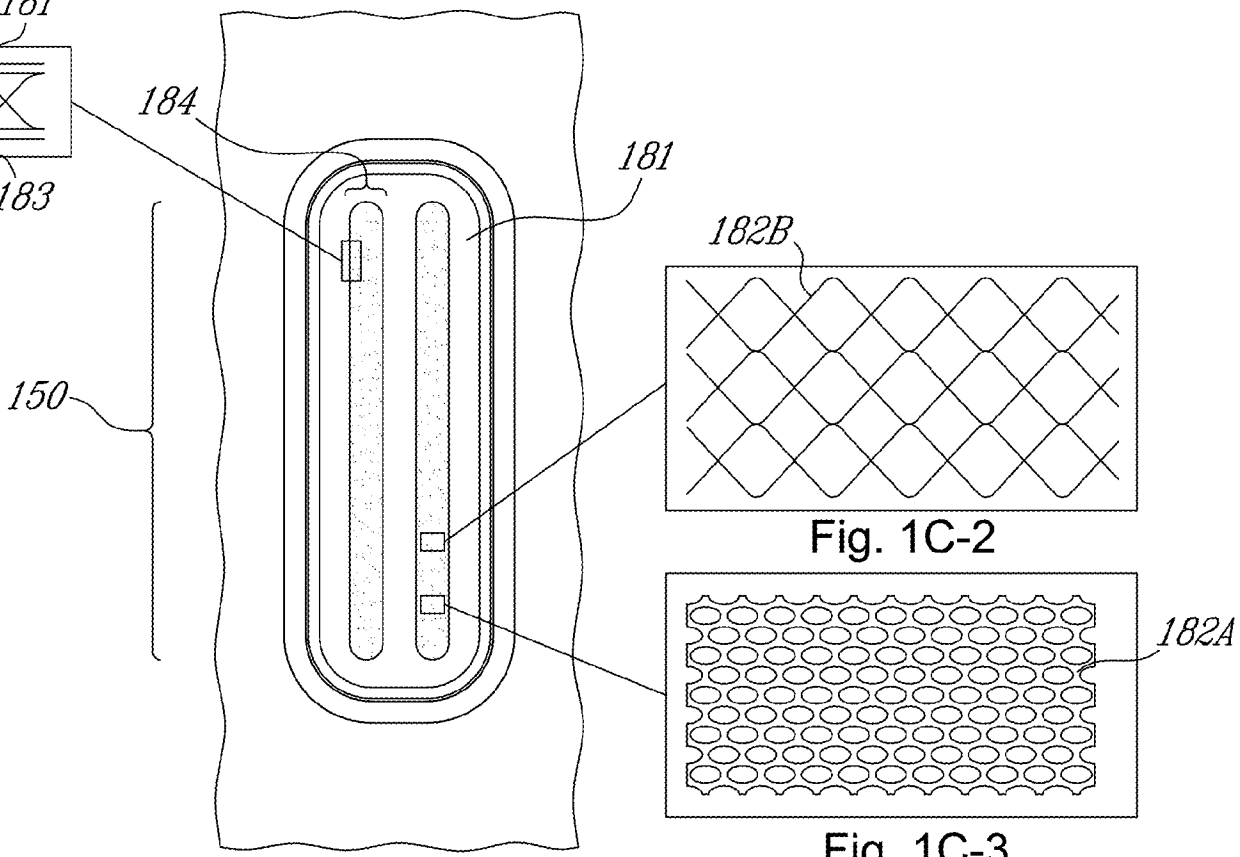
Fig. 1C-2
Fig. 1C-3
Fig. 1C
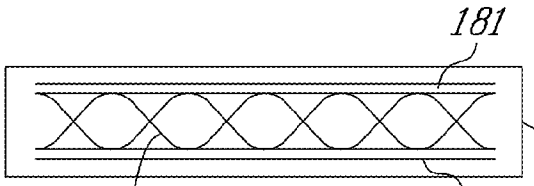
Fig. 1C-1

SHORING SYSTEM USING AT LEAST ONE LIQUID-CONTROLLING SLIDE RAIL

PRIORITY STATEMENT

This non-provisional patent application claims priority based upon the prior U.S non-provisional patent applications entitled "APPARATUS FOR CONTROLLING LIQUID ON A SITE", application Ser. No. 14/180,666, filed Feb. 14, 2014, in the name of Groupe Mammut Inc. and based upon prior U.S provisional patent applications entitled "SHORING SYSTEM USING MULTIPLE LIQUID-CONTROLLING SLIDE RAILS", application No. 61/980,529, filed Apr. 16, 2014, in the names of BOUCHARD, Pierre-Luc, all of which being hereby incorporated by reference.

TECHNICAL FIELD

The present invention relates to controlling liquid accumulation on a site.

BACKGROUND

Under certain regulations, excavations may only be performed where an appropriate dewatering system has been installed (e.g., when digging below the water table). For instance, it may be necessary to lower and maintain the ground water elevation at a minimum of 0.6 meters (two feet) below the base of the excavation. Extracting water or liquid from a site, or controlling its level, may also be relevant for flooding or when a spilling occurred (e.g., resulting in contamination of the site).

In other contexts, water or liquid may be accumulated in a stockpile site.

The present invention provides a solution that is meant to allow for controlling liquid on a site.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

A first aspect of the present invention is directed to a system for shoring an excavation, or the like, comprising a plurality of slide rails with at least one of the plurality of slide rails being a liquid-controlling slide rail. Each liquid-controlling slide rail comprises a hollow body and lateral openings permeable to liquid (e.g., allowing water or air in and out) when the slide rail is positioned into the ground, the openings being positioned on at least a portion of the liquid-controlling slide rail directed outside of the excavation (e.g., allowing water in the hollow body, but not in the excavation). Each liquid-controlling slide rail also comprises a stake tip at one end of the hollow body for facilitating insertion of the liquid-controlling slide rail into the ground and each of the plurality of slide rails comprises at least two plate rails. The system also comprising a plurality of lateral plates, each plate being slid into the plate rails of two adjacent slide rails.

The system may also comprise intermediate beams positioned between opposite slide rails when more than four slide rails are present in the system.

One or more of the plates may comprise one or more surface gutters on at least their outside face for facilitating water drainage by gravity, e.g., towards one or more of the liquid-controlling slide rails in which it is inserted.

The system may also be used, for instance, for excavation into underwater ground, for controlling rising water (e.g. preventing flooding), for better controlling spills (e.g., preventing oil from a spill to reach coasts, etc.).

Liquid-controlling slide rails may present two (e.g., for corner slide rails) or three (e.g., for intermediate sides slide rails) plate rails. Each corner plate rail may be formed by an external steel plate and an internal steel plate soldered onto the exterior of the hollow body. Intermediate plate rail (i.e., center plate rail when there are three plate rails) may be formed by two internal steel plates soldered onto the exterior of the hollow body. External steel plates may have carved out section to avoid blocking the openings in the hollow body. Internal steel plates may intentionally block some of the openings in the hollow body, if ever present thereunder.

The openings may be present over the total length of the hollow body or may be scattered in accordance with expected use cases (e.g., over only the bottom portion or only in the mid portion).

A single pump may be used for a plurality of liquid-controlling slide rails or individual pumps may be used for each liquid-controlling slide rail. The system may also comprise conventional slide rails together with one or more liquid-controlling slide rails.

The liquid-controlling slide rail may comprise a hit plate receiver and a hit plate, removably positioned over the hit plate receiver, for receiving repeated hits. The hit plate may be adapted to transfer force exerted thereon by repeated hits to the hollow stake body for forcing the slide rail into the ground at the site. Once the hit place is removed, the hollow stake body allows for a pump hose to be positioned therewithin for allowing liquid possibly accumulated in the hollow stake body to be pumped out. A pipe may be provided inside the hollow stake body for connecting the pump hose at an upper end.

The hollow stake body may be made of steel. The hit plate receiver may also be made of steel and may have a first end aligned with the opposite end of the hollow stake body. The hit plate receiver may present openings for providing additional weldable surface with the hollow stake body.

The hit plate receiver may be made of steel and may have a first end aligned with the opposite end of the hollow stake body. The first end of the hit plate receiver and the opposite end of the hollow stake body may be inwardly tapered to provide a welding channel.

The hit plate receiver may be made of steel and may have a first end aligned with the opposite end of the hollow stake body and the hit plate receiver, opposite to the opposite end of the hollow stake body, may be shaped such that the length of a weld seam therealong is longer than the perimeter of the hollow stake body near the second end.

The hollow stake body may be a polygonal prism and the hit plate receiver may partially cover bends in the hollow stake body along edges of the polygonal prism.

The hollow stake body may be a polygonal prism and each of the plurality of lateral openings may be positioned on one or more surfaces defined by the polygonal prism.

The plurality of lateral openings may be interspersed for limiting stress formation along the hollow stake body. The plurality of lateral openings may be positioned only towards the stake tip. The slide rail may also provide a liquid tight well point.

The plurality of lateral openings may comprise at least one type of mesh, which may optionally be sandwiched between an outward punctured cover and an inward punctured cover. The outward punctured cover may further comprise elongated apertures along a longitudinal axis of the hollow stake body.

The mesh type may, for instance be a 12×64 stainless steel mesh, a 80μ mesh or a 120μ mesh.

A second aspect of the present invention is directed to a mesh construction for use with an apparatus for controlling liquid level on a site comprising a first punctured cover, a second punctured cover and a mesh assembly, comprising at least one filtration mesh, sandwiched between the first punctured cover and the second punctured cover permeable to liquid when the mesh construction installed on the apparatus is underground at the site.

The mesh assembly may further comprise a protective mesh over the infiltration mesh and the first punctured cover, the first punctured cover being outwardly positioned when the apparatus is underground at the site.

The first punctured cover may comprise elongated apertures along a longitudinal axis of the apparatus for protecting the mesh assembly when the apparatus is being put into the ground at the site. The mesh may be a 12×64 stainless steel mesh, a 80μ mesh or a 120μ mesh.

BRIEF DESCRIPTION OF THE DRAWINGS

Further features and exemplary advantages of the present invention will become apparent from the following detailed description, taken in conjunction with the appended drawings, in which:

FIGS. 1C, 1C-1, 1C-2 and 1C-3 are hereinafter referred to as FIG. 1C, which is a perspective view of an exemplary mesh assembly in accordance with the teachings of the present invention;

FIG. 1D is an exploded perspective view of an exemplary apparatus for allowing control of liquid level on a site in accordance with the teachings of the present invention;

FIG. 2 is a perspective view of an exemplary apparatus for allowing control of liquid level on a site in accordance with the teachings of the present invention;

DETAILED DESCRIPTION

Embodiments of the present invention relate to a system for shoring an excavation, or the like, comprising a plurality slide rails with at least one of liquid-controlling slide rail (i.e., one embodiment of the apparatus shown on the various figures).

Figure 1A:
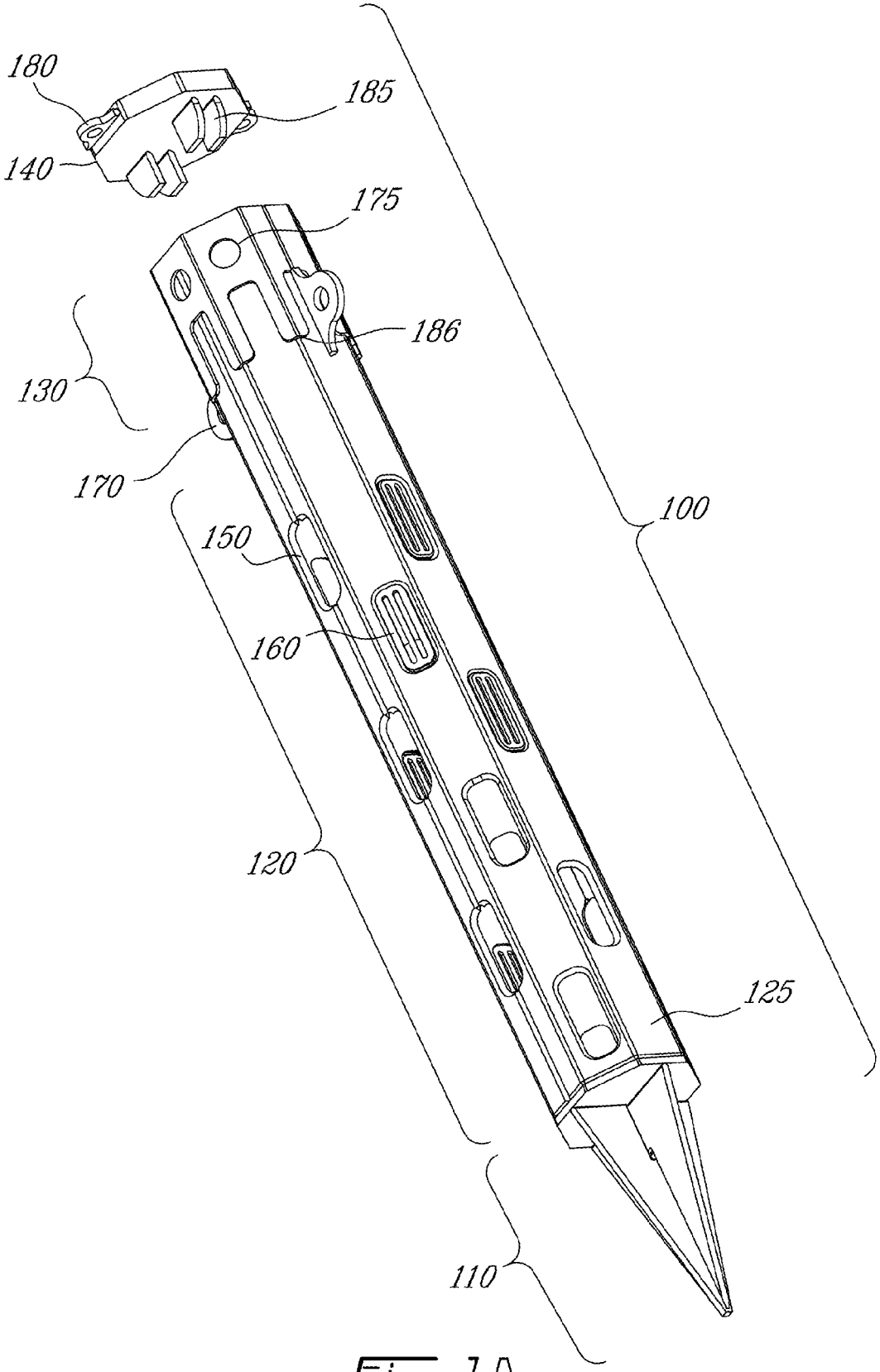
FIG. 1A is a perspective view of an exemplary apparatus for allowing control of liquid level on a site in accordance with the teachings of the present invention.

Reference is now made concurrently to FIGS. 1A to 12 of the accompanying drawings in which FIG. 1A shows a perspective view of an exemplary apparatus for allowing control of liquid level on a site in accordance with teachings of the present invention. The apparatus 100 is suitable when the liquid is water. Skilled persons will appreciate that other liquids may also be controlled. For instance, and without limitation, the liquid may be a mix of water and a petroleum product in different concentration (oil, gas, diesel, mix of any of these, etc.) or the petroleum product itself. The apparatus 100 may provide different configuration depending on the intended use.

The apparatus 100 may also be used to control contaminated liquid accumulated due to, for example, soil contamination. Attention is now drawn to FIG. 1A showing a partially assembled perspective view of the exemplary apparatus 100. The exemplary apparatus 100 comprises a hollow stake body 120 permeable to liquid (e.g., allowing water or air in and out of the hollow body 120) through a plurality of openings 150, when positioned into the ground, a stake tip 110 at one end of the hollow stake body 120 for facilitating insertion of the apparatus 100 into the ground and a hit pleee plate receiver 130 at an opposite end of the hollow stake body 120. The hit plate receiver 130, in its simplest form, allows positioning of a hit plate 140 at the top and of the hollow body 120 and may be integrated into the hollow body 120. The hit plate receiver 130, when provided as an additional component, may further solidify the hollow body 120 of the exemplary apparatus 100 and increase its resistance to repeated hits. The hollow stake body 120 and the hit plate receiver 130 of the exemplary apparatus 100 may be made out of steel. The steel may be, for example, stainless, Hardox™ or Scandia™. Skilled persons will notice that the sort of steel may vary without departing from the teachings of the present invention. The hollow stake body 120 and the hit plate receiver 130 may instead be made of other materials capable of withstanding the force of repeated hits. For instance, cast iron or other metal alloys may be suitable in some embodiments. The hollow stake body 120 and the hit plate receiver 130 could be provided in a single material/ piece or could be provided in multiple assembled elements joined together (e.g., welded) to withstand expected forces.

The exemplary apparatus 100 may also comprise a hit plate 140, removably positioned over the hit plate receiver 130 for receiving repeated hits. The hit plate 140 is adapted to transfer force exerted thereon by repeated hits to the hollow stake body 120 for forcing the apparatus 100 into the ground at the site. Once the hit plate 140 is removed, the hollow stake body 120 allows for a pump hose to be positioned therewithin for allowing liquid possibly accumulated in the hollow stake body 120 to be pumped out (not shown). A skilled person will readily recognize that other means for inserting the exemplary apparatus 100 into the ground at an excavation site may be used aside for repeated hits, such as continuously applying longitudinal pressure to the exemplary apparatus 100. In an alternate embodiment of the hit plate 140 an opening (e.g., in the center thereof; not shown) may be provided to allow a hose of a pump (not shown) to reach the inside of the hollow stake body. The exemplary apparatus 100 may allow a submersible pump (not shown) to be installed directly within the hollow body 120 (e.g., after positioning of the apparatus 100 on the site or, if the pump is installed to resist and able to resist the repeated hits, before positioning of the apparatus 100 on the site). The pump may also be installed in an air tight (or liquid tight) manner, to actively draw liquid from the ground via the openings 150, 160 in the hollow body 120. For example, an additional sealing component (not shown) may be provided in the hollow body 120 between the uppermost opening(s) and the upper end of the hollow body 120 to allow the air tight pump installation. A skilled person in the art would readily recognize that such features would not affect the teachings of the present invention. In a preferred embodiment, the hit plate 140 is 3" thick. Skilled persons will recognize that the thickness of the hit plate 140 may vary without departing from the teachings of the present invention. In an alternative embodiment, the liquid tight installation may also allow for the connection of multiple exemplary apparatuses 100 to a single pump for removal of accumulated liquid in the exemplary apparatuses 100. The exemplary apparatus 100 may also be used as a well point.

When an air tight installation is provided, the pump may also be used in reverse compared to the previous example (or another more suitable pump may be used) to pump air into the exemplary apparatus 100 in order to send the pumped air into the surrounding ground through the openings 150, e.g., in order to improve or accelerate the dry off of the ground. This exemplary embodiment is expected to be particularly useful when the apparatus 100 is used on a stockpile that would benefit from being dryer (e.g., before being transported elsewhere for disposal).

In a preferred embodiment, the length of the hollow stake body 120 is 132" and the internal width of the hollow stake body 120 is 16"31/32. The external width, in other words the width calculated from opposite points on the outer surfaces of the hollow stake body 120, is 18"15/32. Of course, skilled persons will notice that the dimensions of the apparatus 100 may vary without departing from the teachings of the present invention (i.e., the width, height or shape may differ). In an alternate embodiment of the apparatus, a smaller version of the apparatus has a hollow stake body with a length of 71"¾, a stake tip of 33" in length and a hit plate with a thickness of 3". Skilled persons will readily understand that the apparatus 100 may be provided in a range of length and with any number of openings 150 based on the expected use case. The present invention is not limited to the described variants.

The hollow stake body 120 of the exemplary apparatus 100 may be of a polygonal prism. The polygonal prism may be regular, convex or right. In a preferred embodiment, the hollow stake body 120 is a right octagonal prism with regular octagons for bases and rectangular faces assembled from two half shells. However, persons skilled in the art will readily recognize that the hollow stake body 120 may be defined otherwise, such as a cylinder, or a rectangular prism without affecting the teachings of the present invention.

In the exemplary apparatus 100, the hit plate receiver 130 is depicted as a separate component provided on the exterior of the hollow stake body 120. The hit plate receiver 130 could also be provided on the inside of the hollow stake body 120, even though it appears less practical during assembly of the apparatus 100. The hit plate receiver 130, in some embodiments, is assembled from two half shells over the hollow body 120 and partially covers edges of the polygonal prism (e.g., bends in the hollow stake body 120). The covered edges likely provide higher resistance to repeated hits then if they were uncovered (e.g., prevents or limits buckling of the hollow stake body 120).

In one embodiment, the hit plate receiver 130 has a first end aligned with the top end of the hollow stake body 120. As such, the hit plate receiver 130 may be placed onto the hollow stake body 120 as such that it is hugging the hollow stake body 120. This positioning is for reinforcing the top end of the exemplary apparatus 100 that receives the repeated hits (e.g., as force from the repeated hits is transferred from the hit plate 140 onto the hit plate receiver 130). Additionally, the hit plate receiver 130 and the top end of the hollow stake body 120 of the exemplary apparatus 100 may be inwardly tapered in order to provide a welding channel. The welding channel may be provided for increasing the strength of the bond between the hollow stake body 120 and the hit plate receiver 130 while allowing a straight top surface to be formed at the top of the hollow body 120 (for instance, at the time of welding or after simple machining (e.g., buffing) of the weld).

The hit plate receiver 130 may also present openings for providing additional weldable surfaces 175 with the hollow stake body 120. The additional weldable surfaces 175 may be provided for increasing strength of the bond between the hit plate receiver 130 and the hollow stake body 120. In a preferred embodiment, the additional weldable surfaces 175 are circular and present on each of the prism's faces. However, persons ordinarily skilled in the art will note that the shape of these additional weldable surfaces 175 may be of different shape than that of a circle, such as that of a polygon, without affecting the teachings of the present invention. In a preferred embodiment, there are 6 additional, circular weldable surfaces, where each additional circular surface is located on a different face of the hit plate receiver 130. The additional weldable surfaces 175 or various shapes (not shown) may optionally be provided at the edge of the hit plate receiver 130 or throughout the hit plate receiver 130.

The bottom end of the hit plate receiver 130, opposite to the top end of the hollow stake body 120, may be shaped such that the length of a weld seam 186 therealong is longer than the perimeter of the hollow stake body 120 near the second end for increasing the welding surface between the hollow stake body 120 and the hit plate receiver 130. As such, the increased welding surface increases the strength of the bond between the hit plate receiver 130 and the hollow stake body 120. In a preferred embodiment, the weld seam 186 is shaped as a set of protruding teeth along the edges of the hollow stake body 120, although skilled persons will recognize that other forms of the weld seam 186 may be used in order to achieve a weld seam where its length is greater than the perimeter of the hollow stake body 120.

Figure 1B:
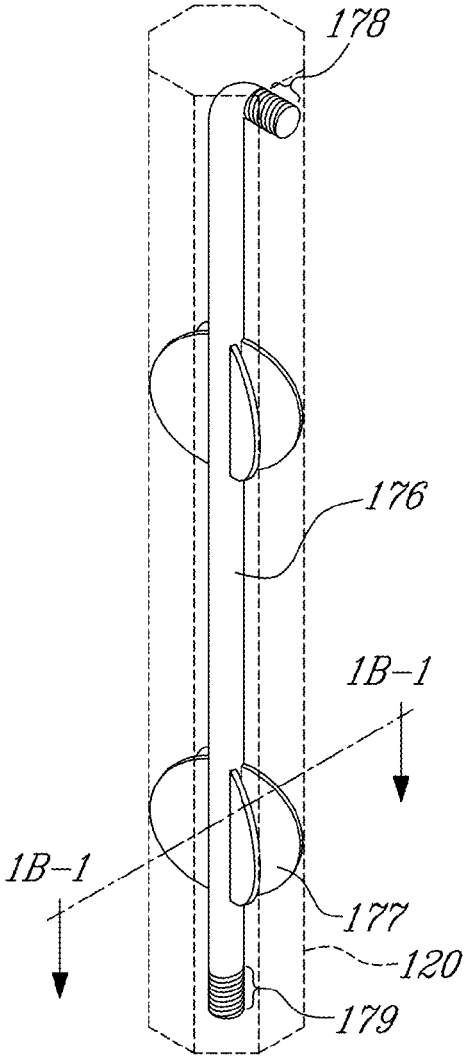
FIGS. 1B and 1B-1, concurrently referred to as FIG. 1B, are respectively a perspective view and a top-down cross-sectional view of an exemplary stake hollow body in accordance with the teachings of the present invention.
Figures 1, 1B:
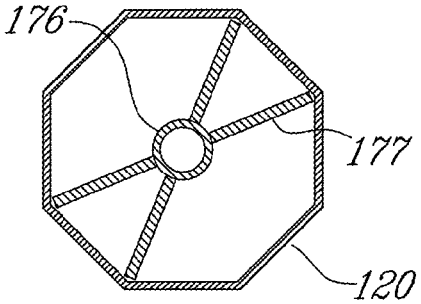
Figure 10:
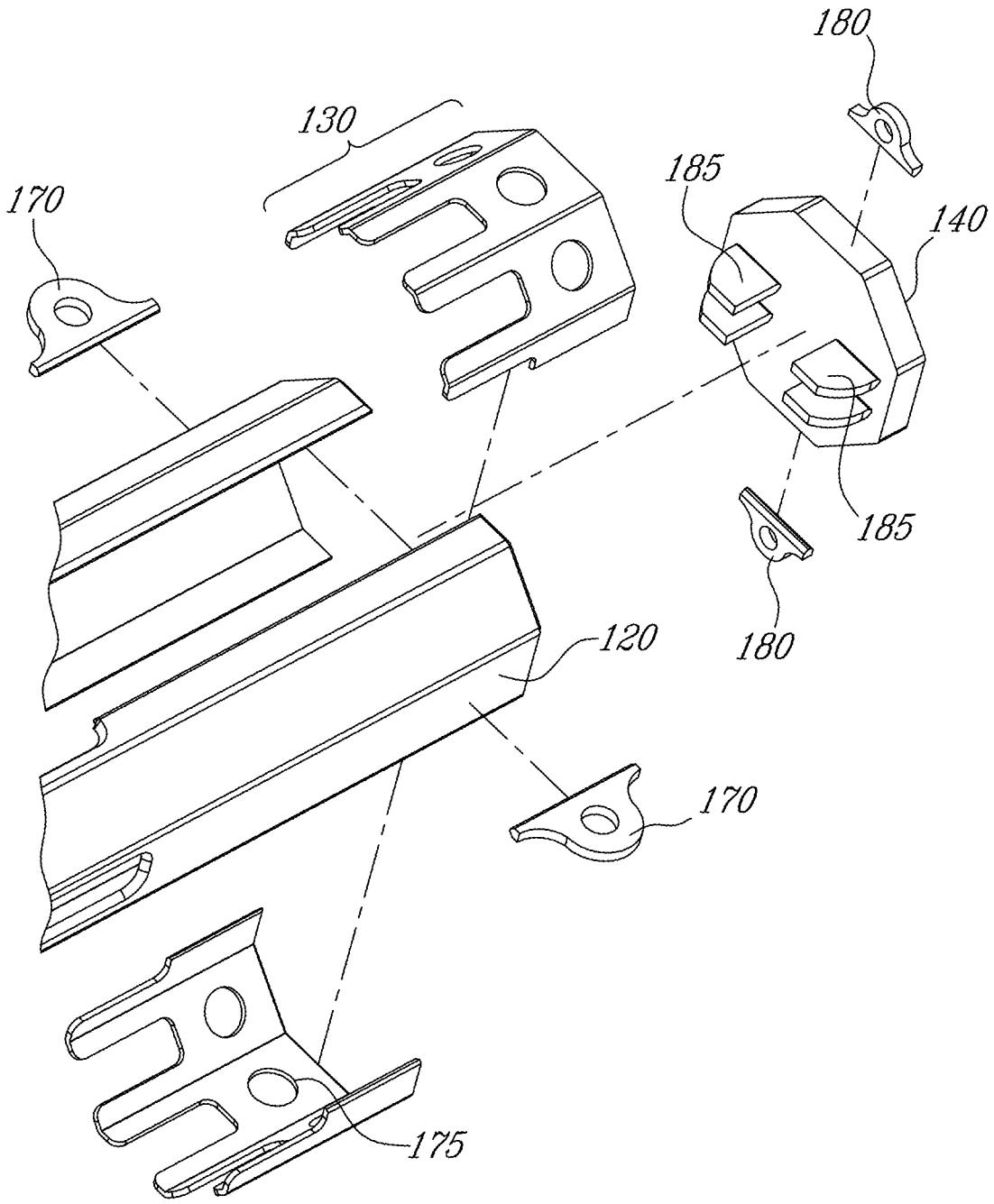
FIG. 10 is a first top view of an exemplary shoring system comprising liquid-controlling slide rails (i.e., one embodiment of the apparatus shown on other figures) in accordance with the teachings of the present invention

FIG. 1B shows a perspective view and a top-down cross-sectional view of the exemplary apparatus 100. The exemplary apparatus 100 may comprise a pipe 176 inside the hollow stake body 120 allowing for liquid possibly accumulated therein at a lower end and for connecting the pump hose at an upper end. In a preferred embodiment, the pipe 176 may be joined to the apparatus using supports 177. In a preferred embodiment, the pipe 176 is located in the center of the hollow stake body 120. However, a skilled person in the art will readily recognize that other means of joining the pipe 176 to the hollow stake body 120, other pipe shapes and/or other pipe positioning may be used without affecting the teachings of the invention. In an alternate embodiment, the pipe 176 may be connected directly to the pump. The pipe 176 may be joined to a pump hose through a pump attachment 178. In the exemplary embodiment 100, the pump attachment 178 is curved, which may be useful for preventing the attached pump from folding onto itself and blocking the flow of liquid. Skilled persons recognize that the pipe 176 and the pump attachment 178 may have a different shape without diverging from the teachings of the present invention. The pipe 176 may provide an additional attachment end 179 for attaching to a submersible pump or a filter. Skilled persons will recognize that other apparatuses may be attached to the additional attachment end 179 without diverging from the teachings of the present invention. The pipe 176 may be made, for example, of rubber, plastic or metal. However, skilled persons will recognize that the pipe 176 may be made in other materials without affecting the teachings of the present invention. In a preferred embodiment, the pipe 176 is added into the hollow body 120 after positioning of the apparatus 100 at the site. However, skilled persons will recognize that the pipe 176 may be added before or during the assembly of the apparatus 100. In exemplary embodiments, the submersible pump connected at the pipe 176 through the additional attachment end 179 may have a diameter that fits within the hollow body 120.

As shown in FIG. 1A and FIG. 1D, in a preferred embodiment, the hit plate 140 comprises a first pair of handles 180 which are attached to the hit plate 140. In the depicted example, the handles 180 are placed symmetrically at opposite ends of one another. The first pair of handles 180 may be welded, for example, to the hit plate 140. However, other means for attaching these handles 180 may be used. The handles 180 may be for positioning the hit plate 140 onto and removing the hit plate 140 from the exemplary apparatus 100. For example, the removal of the hit plate 140 may be performed after reaching a desired depth with the apparatus 100 and before insertion of the pump hose into the hollow stake body 120 which will remove liquid accumulated within (not shown). Alternate embodiments of the hit plate 140 may provide one, two, or more handles 180. The position of the handles 180 may also vary along the hit plate 140 without departing from the teachings of the present invention. Additionally, a person ordinarily skilled in the art will readily recognize that the handles 180 may be replaced by other means of offering a latching point for removing the hit plate 140, such as a pair of protruding bars or protruding bolts, without affecting the teachings of the invention (not shown).

A preferred embodiment of the present invention also comprises a second pair of handles 170. The handles 170 are attached to the hollow stake body 120. The second pair of handles 170 may be welded, for example, to the hollow stake body 120 (e.g., between the body 120 and the receiver 130). However, other means for attaching these handles 170 may be used. An alternate embodiment may present an apparatus where one, or more than two handles 170 are attached to the hollow stake body 120. In the depicted example, the handles 170 are placed symmetrically at opposite ends of one another for improving and optimizing the removal of the exemplary apparatus 100 from the ground. The position of the handles 170 may also vary along the hollow body 120 without departing from the teachings of the present invention. The pair of handles 170 may be for extracting the apparatus 100 from the ground, using, for example, hooks which may be inserted into the handles 170, where an upward force, exerted by a crane, for example, will hoist the exemplary apparatus 100 from the ground for removal from the excavation site. A person ordinarily skilled in the art will readily recognize that the first pair of handles 170 may be replaced by other means of offering a latching point for removing the exemplary apparatus 100 from the ground, such as a pair of protruding bars or protruding bolts, without affecting the teachings of the given invention (not shown).

As shown in FIG. 1D, in a preferred embodiment of the exemplary apparatus 100, the hit plate 140 may comprise a set of reinforcements 185. The exploded view of FIG. 1D provides a perspective view of the upper part of the exemplary apparatus 100. In a preferred embodiment, the pair of reinforcements 185 are placed symmetrically at opposite ends from one another, on a surface of the hit plate 140, in such a way that the pair of reinforcements 185 will be enclosed within the hit plate receiver 130, and subsequently the exemplary apparatus 100, when the hit plate 140 is to be positioned onto the hit plate receiver 130. The pair of reinforcements 185 may further facilitate the placement of the hit plate 140 onto the hit plate receiver 130, functioning as a guide during the positioning of the hit plate 140. The reinforcements 185 may also allow the hit plate 140 to better keep its shape over time as the hit plate 140 recurrently receives repeated hits. Without the reinforcements 185, the hit plate 140 may be more prone to deforming under the applied force of the repeated hits, causing the removal of the hit plate 140 to be difficult for subsequent use. The pair of reinforcements 185 may further be provided for reinforcing the overall structure of the hit plate 140. The number of reinforcements 185 found on the hit plate 140, as well as the positioning of the reinforcements 185 on the hit plate 140, may vary without affecting the teachings of the present invention.

The plurality of lateral openings 150 of the exemplary apparatus 100 may be positioned on one or more surfaces 125 defined by the polygonal prism. The plurality of lateral openings 150 may be interspersed for limiting stress formation along the hollow stake body 120. A preferred embodiment comprises three lateral openings 150 on each face of the hollow stake body 120, totaling 24 lateral openings 150, where the lateral openings 150 found on each face are offset in regards to the lateral openings 150 found on an adjacent face. Another embodiment of the exemplary apparatus 100 may provide that the plurality of lateral openings is interspersed on a circular surface of a hollow stake body.

The exemplary apparatus 100 may also provide the plurality of lateral openings 150 towards the stake tip 110 for improving the capture of liquid deeper into the ground. However, skilled persons will recognize that the number lateral openings 150, the organization into rows, the positioning and the size of the lateral openings 150 may vary without affecting the teachings of the present invention.

As shown on FIG. 1C, the plurality of lateral openings 150 of the exemplary apparatus 100 may also comprise at least one type of mesh 182A and/or mesh 182B, concurrently defined as mesh 182. The mesh 182 allows liquid to permeate into the hollow stake body 120 while blocking undesired debris. The mesh may be selected considering the liquid to be controlled (e.g., when thicker petroleum products is expected, to avoid or limit clogging). A person skilled in the art will readily recognize that the mesh 182 may be replaced by another material which allows liquid to permeate through a surface (e.g. a filter, a very fine sieve) without affecting the teachings of the present invention. A mesh is defined as a woven, knit, or knotted material of open texture with evenly spaced holes or as like a web-like pattern or construction. In the exemplary apparatus 100, the mesh 182 may be a 12×64 stainless steel mesh, a 80μ mesh or a 120μ mesh. Stainless steel is chosen for the composition of the mesh 182 in order to reduce corrosion of the mesh 182. A skilled person in the art will readily recognize that the mesh 182 may be of a different type along a single apparatus 100 based on an intended use (e.g., finer mesh at the bottom opening 150 of the apparatus 100 compared to the higher openings 150). Likewise, the mesh 182 itself may also present a different permeability along its length and/or width.

The mesh 182 of the exemplary apparatus 100 may be sandwiched between an outward punctured cover 181 and an inward punctured cover 183. The outward punctured cover 181 may comprise elongated apertures 184 along a longitudinal axis of the hollow stake body 120. The elongated apertures 184 may prevent foreign bodies found in the ground (e.g. rocks, roots, twigs) from puncturing or damaging the mesh 182. However, a skilled person will recognize that other means for protecting the mesh 182, such as, for example, a wire grid, may be used in addition or in replacement of the elongated apertures 184. The mesh 182 may be welded to the outward punctured covered 181 and the inward punctured cover 183. However, other means for attaching the mesh 182 to the outward punctured cover 181 and the inward punctured cover 183 may be used, such as bolts, which facilitates the replacement of the mesh 182. Replacement of the mesh 182 may be for use of the exemplary apparatus 100 in different ground compositions or to facilitate the replacement of a damaged mesh. The outward punctured cover 181 may be thicker (e.g., when compared to the inward punctured cover 183 or the mesh 182) for preventing deformation of the mesh assembly.

Figure 2:
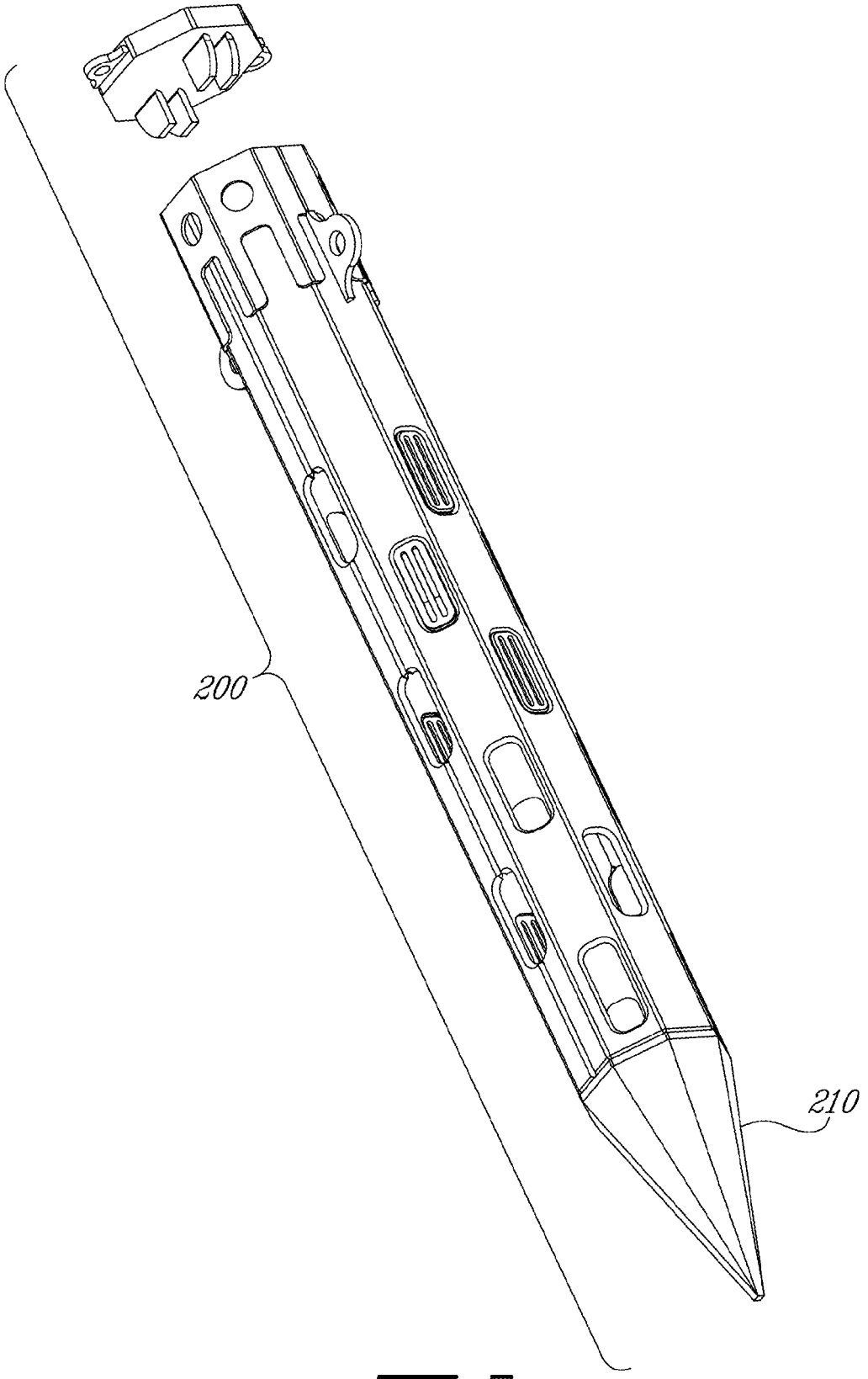

FIG. 2 shows an exemplary apparatus 200 where the stake tip 210 is of a filled, pyramidal shape. Persons skilled in the art will note that the shape of the stake tip 210 may vary as long as the stake tip 210 fills its function of facilitating piercing of the ground when force is applied in a downward direction on the exemplary apparatus 200 without affecting the teachings of the present invention. Alternative embodiments may provide a stake tip, for instance, in the shape of a marker or a fence pole.

Figure 3A:
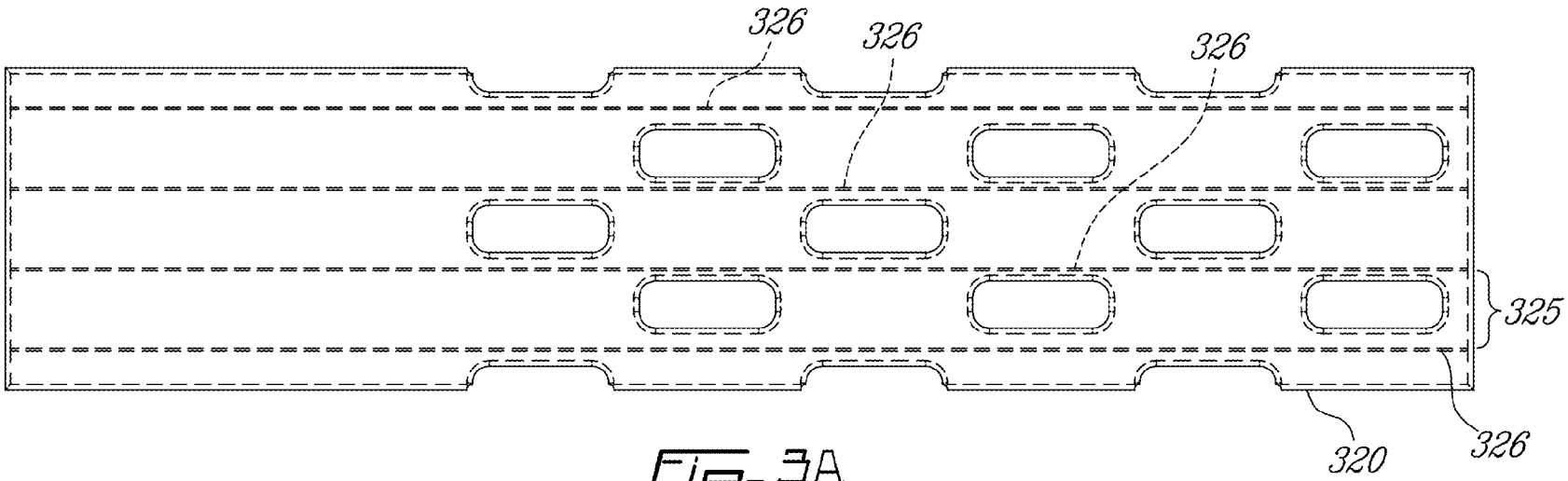
FIG. 3A and FIG. 3B, concurrently referred to as FIG. 3, are respectively a perspective view of an exemplary disassembled hollow stake body component and an exemplary disassembled hit place receiver component in accordance with the teachings of the present invention.
Figure 3B:
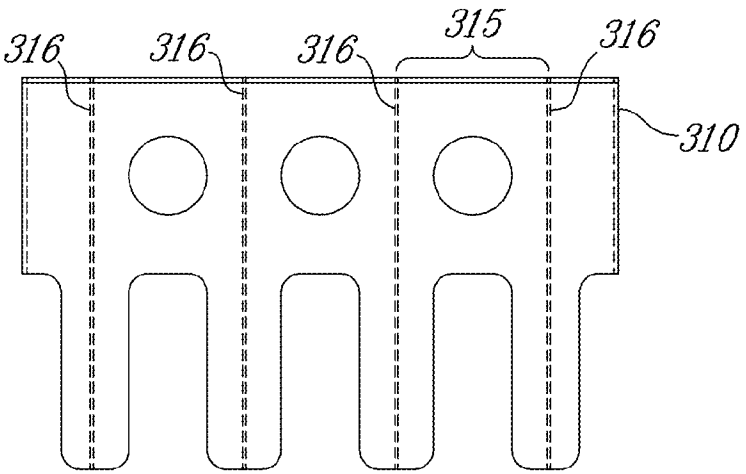

FIG. 3 shows a perspective view of some disassembled components of an exemplary apparatus for allowing control of liquid level on a site. A hollow stake body may be made using two hollow stake body sheets 320. The hollow stake body sheet 320 may be folded along bends 326, delimiting faces 325 of a polygonal prism, in the longitudinal direction of the hollow stake body, in order to form half of the polygonal prism. A preferred embodiment comprises four bends 326 on the hollow stake body sheet 326. Two hollow stake body sheets 320 may be placed opposite to one another to form the hollow stake body. The two hollow stake body sheets 320 may be, for example, welded to one another for solidifying the hollow stake body. A person skilled in the art will recognize that a hollow stake body may be composed of one hollow stake body sheet, where one of the longitudinal edges meets the other longitudinal edge once the hollow stake body sheet is folded, or more than two sheets (e.g., welded together) without diverging from the teachings of the present invention (not shown).

A hit plate receiver may be made using two hit plate receiver sheets 310. The hit plate receiver sheet 310 may be folded along a bend 316, delimiting faces 315 of a polygonal prism, in the longitudinal direction of the hit plate receiver, in order to form half of the polygonal prism. A preferred embodiment comprises four bends 316 on the hit plate receiver sheet 310. Two hit plate receiver sheets 310 may be placed opposite to one another to form the hit plate receiver. The hit plate receiver sheets 310 may be welded to one another for solidifying the hit plate receiver. A person skilled in the art will recognize that a hit plate receiver may be composed of one single hit plate receiver sheet, where one of the longitudinal edges meets the other longitudinal edge once the hit plate receiver sheet is folded along its bends, or more than two sheets (e.g., welded together) without diverging from the teachings of the present invention (not shown). In another embodiment, the hit plate receiver 130 is shaped as a cylinder having an internal diameter that matches the longest external diagonal of the base of the hollow body 120. The hit plate receiver 130 can then be positioned over the hollow body 120 (e.g., press fit, welded, etc.) to provide its intended function.

Figure 4A:
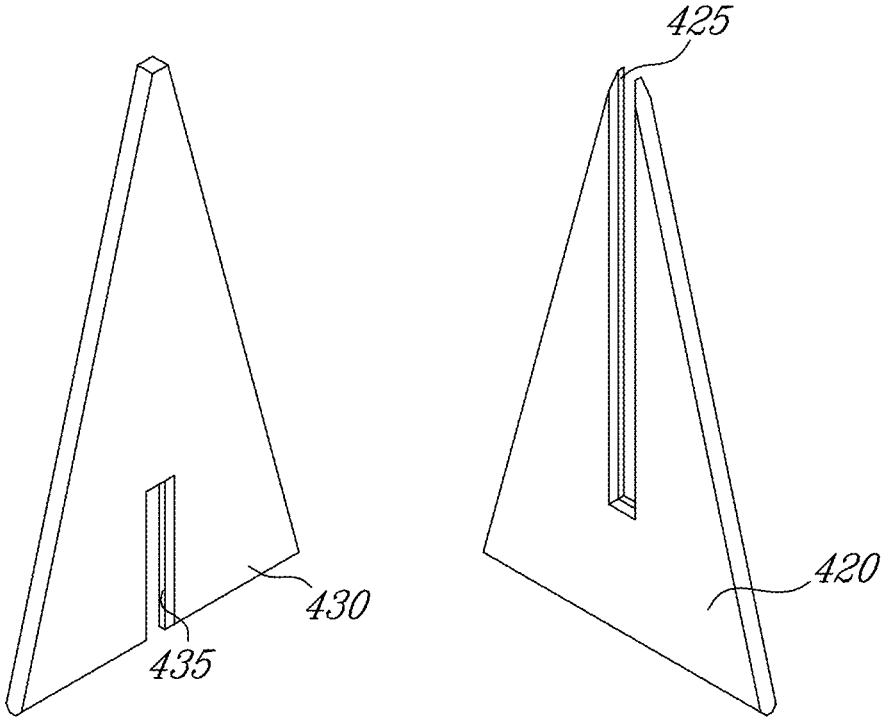
FIG. 4A and FIG. 4B, concurrently referred to as FIG. 4, are perspective views of disassembled components of an exemplary stake tip in accordance with the teachings of the present invention.
Figure 4B:
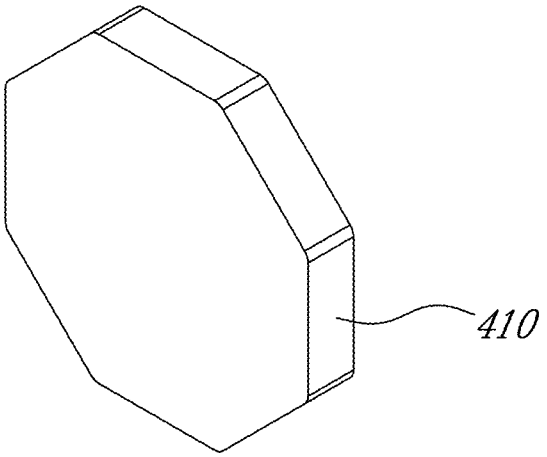

FIG. 4 shows a perspective view of some of the disassembled components of an exemplary embodiment of a stake tip of an exemplary apparatus for allowing control of liquid level on a site. A first wedge 430 may be inserted into a spacing 425 of a second wedge 420. In turn, the second wedge 420 falls into a spacing 435 of the second wedge 430. The spacing of the first wedge 425 and the spacing of the second wedge 435 provide an assembly method which increases the overall stability of the stake tip. The assembled first 430 and second 420 wedges may be attached (e.g., welded) to one another and onto a polygonal shaped plaque 410. The plaque 410 may be of another shape than that of a polygon, such as an oval or a circle, as long as the hollow stake body and the hit plate receiver have a shape compatible with the plaque 410. In a preferred embodiment, the plaque 410 is 1" thick. Skilled persons will notice that the thickness of the plaque 410 may vary without departing from the teachings of the present invention.

Figure 5:
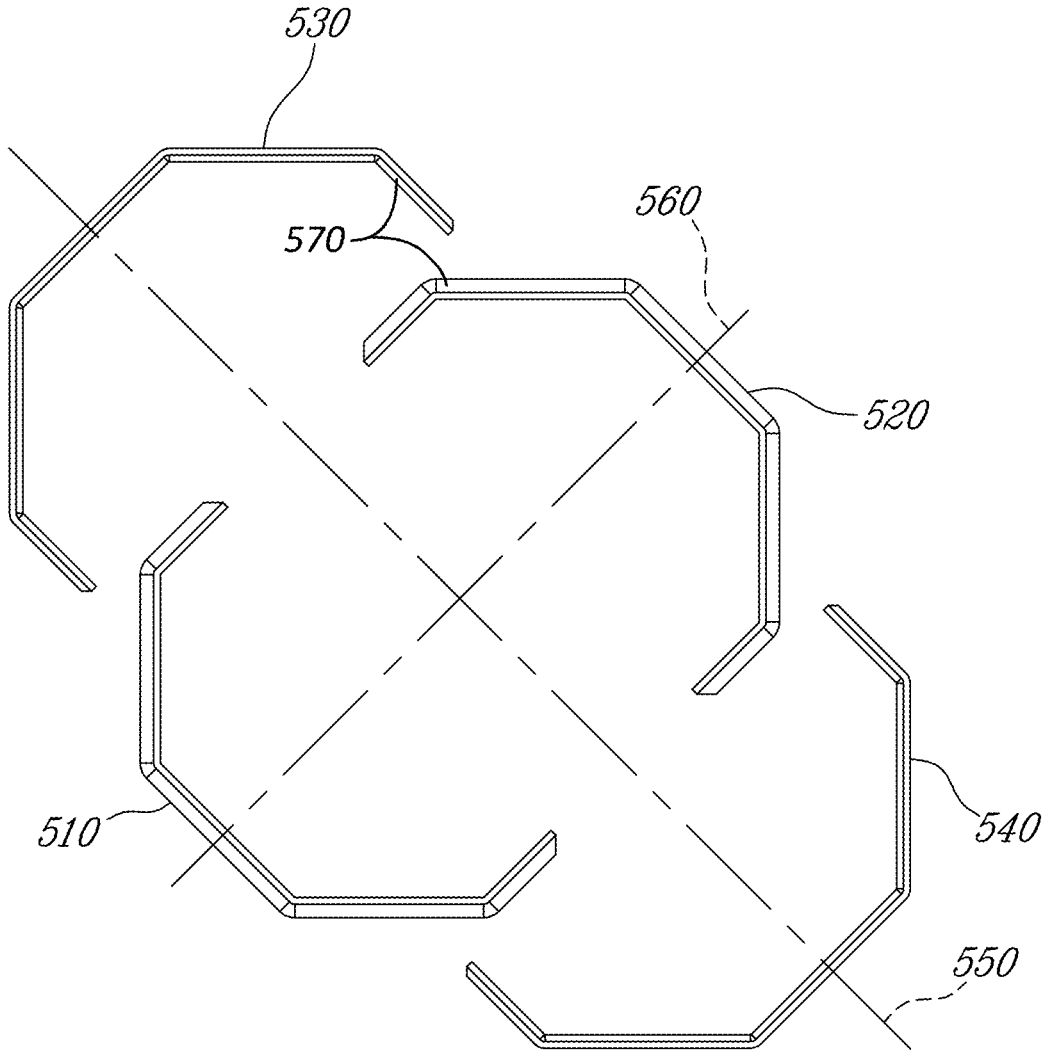
FIG. 5 is a top-down view of a disassembled exemplary hollow stake body and a disassembled exemplary hit plate receiver of an exemplary apparatus in accordance with the teachings of the present invention.

FIG. 5 shows a top-down view of a disassembled hollow stake body and hit plate receiver of an exemplary apparatus for allowing control of liquid level on a site. The hollow stake body may be composed of two parts, a first part 510 and a second part 520, where both parts may be assembled to form a polygonal prism. A first axis of symmetry is formed passing through the points marking where the first part 510 and the second part 520 meet. The hit plate receiver may also be composed of two parts, a first part 530 and a second part 540, where both parts may be assembled to form the hit plate receiver. A second axis of symmetry is formed passing through the points marking where the first part 530 and the second part 540 of the hit plate receiver meet. The first axis of symmetry 550 and the second axis of symmetry 560 are placed relative to one another in such a way to minimize stress points of the apparatus, where a welding seam is a stress point and so the welding points are not juxtaposed. The first part 510 and second part 520 may be welded together once assembled, to form the hollow stake body. The first part 530 and second part 540 may be welded together once assembled, to form the hit plate receiver. As mentioned with reference to the embodiment of FIG. 1, a welding channel 570 may be provided between the hollow stake body and the hit plate receiver when assembled. During assembly, a welding seam at least partly fills the welding channel 570. In some embodiments, the welding seam completely fills the welding channel 570 and it may be necessary to machine (e.g., buff) excess material therefrom to form a straight top surface. FIG. 5 provides exemplary axis of symmetry that may provide different angular differences.

Figure 6:
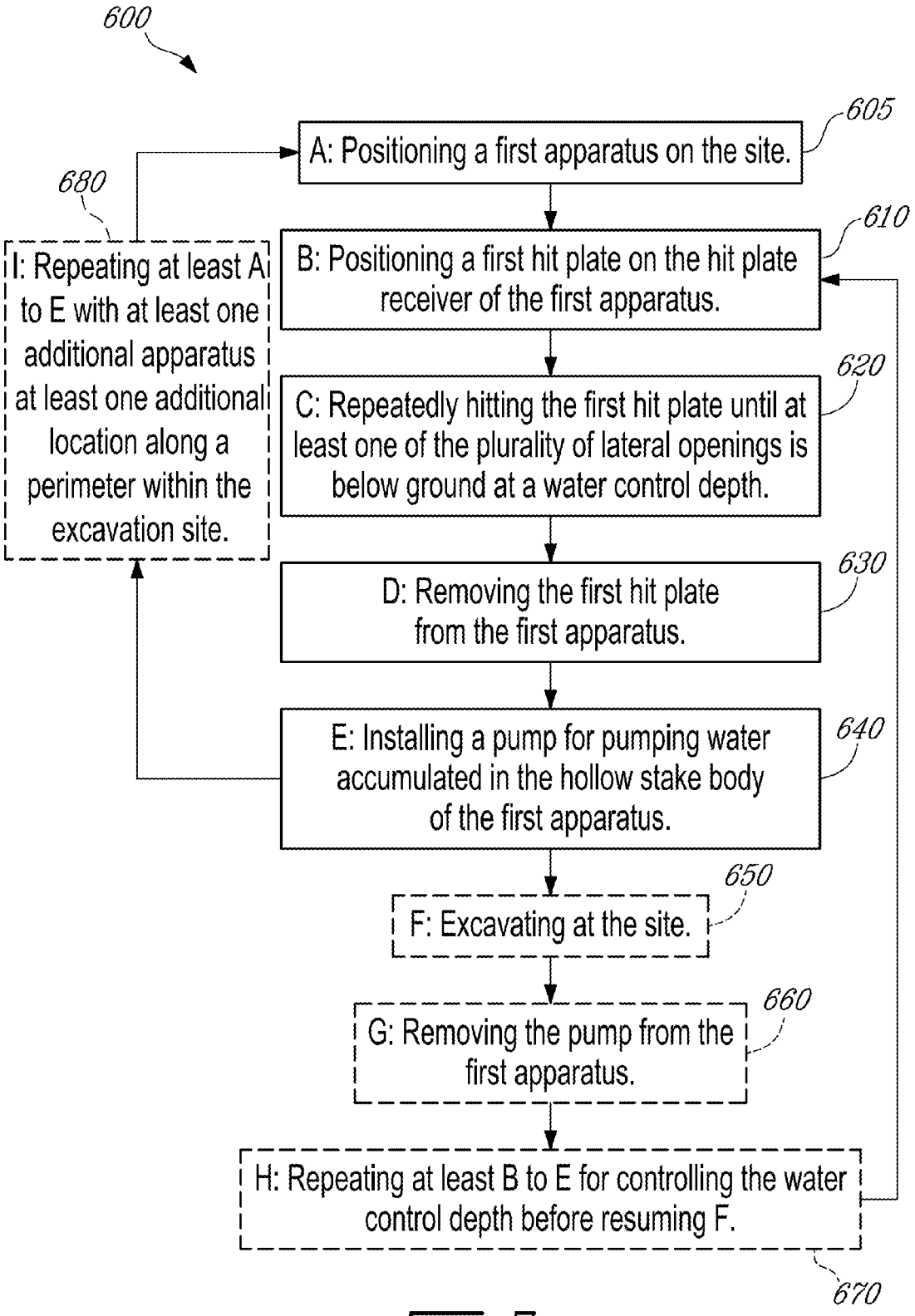
FIG. 6 is a flow chart of an exemplary method for controlling liquid level on an excavation site in accordance with the teachings of the present invention.

FIG. 6 shows a flow chart of an exemplary method 600 for controlling liquid level on an excavation site. The method 600 comprises positioning, at one location on the site, a first apparatus comprising a hollow stake body (A; 605). The hollow stake body comprises a plurality of lateral openings permeable to liquid (e.g., allowing liquid to enter and/or air to exit), a stake tip at one end of the hollow stake body and a hit plate receiver at an opposite end of the hollow stake body. The method 600 also comprises positioning a first hit plate on the hit plate receiver of the first apparatus (B; 610) and then repeatedly hitting the first hit plate until at least one of the plurality of lateral openings is below ground at a liquid control depth (C; 620). This force is for driving the apparatus into the ground. Additionally, the method 600 comprises removing the first hit plate form the first apparatus (D; 630). The method 600 also comprises installing a pump for pumping liquid accumulated in the hollow stake body of the first apparatus (E; 640), thereby removing the accumulated liquid.

The method 600 may also further comprise excavating the site (F; 650), removing the pump from the first apparatus (G; 660) and repeating at least B to E, as shown on FIG. 6, for controlling the liquid control depth before resuming F (H; 670). These actions allow for removal of liquid at an excavation site at continuously lower depths in the ground as the excavation progresses and more liquid, found in the ground, hinders the progression of the excavation.

The method 600 may comprise repeating at least A to E, as shown on FIG. 6, with at least one additional apparatus and at least one additional location along a perimeter within the excavation site (I; 680) using multiple apparatuses for covering a larger surface area in the case of a larger excavation site. In a preferred embodiment, four apparatuses, therefore three additional apparatuses, are positioned in a parallelogram formation in order to cover a maximum area of an excavation site. Each apparatus covers optimally a given area of the excavation site in order to drain liquid. The emplacement of each apparatus in regards to one another should be such as to reduce overlap of the liquid drainage surface area over the excavated area.

Another aspect of the invention is a mesh construction for installing onto an apparatus for controlling liquid level on a site which comprises a first punctured cover, a second punctured cover and a mesh assembly. The mesh assembly comprises at least one filtration mesh, which may be sandwiched between a first punctured cover and a second punctured cover for allowing liquid and/or air therethrough when the mesh construction installed on an apparatus underground at a site. The mesh assembly may comprise a mesh type which is a 12×64 stainless steel mesh, an 80μ mesh or a 120μ mesh. Stainless steel is chosen for the composition of the mesh assembly in order to reduce corrosion of the mesh assembly. A person skilled in the art will readily recognize that the mesh assembly may be replaced by another type of mesh without affecting the teachings of the present invention. The filtration mesh may be welded to the first punctured cover and to the second punctured cover. However, other means for attaching the mesh to the first punctured cover and the second punctured cover may be used, such as bolts, which facilitates the replacement of the mesh. Replacement of the mesh may be for use of the exemplary apparatus in different ground compositions or to facilitate the replacement of a damaged mesh.

The mesh construction may also be placed on the walls of a trench cage in an excavation site for allowing liquid from the ground around the trench cage, which further allow for stabilizing the ground neighboring the trench cage. One or more apparatuses 100 for controlling liquid level on a site may be placed inside the trench cage for receiving liquid draining from the mesh constructions. Skilled person will recognize that the mesh construction may be used in different context on different types of devices where liquid may be controlled from ground on a side of such devices (e.g., during ground shoring).

Figure 7:
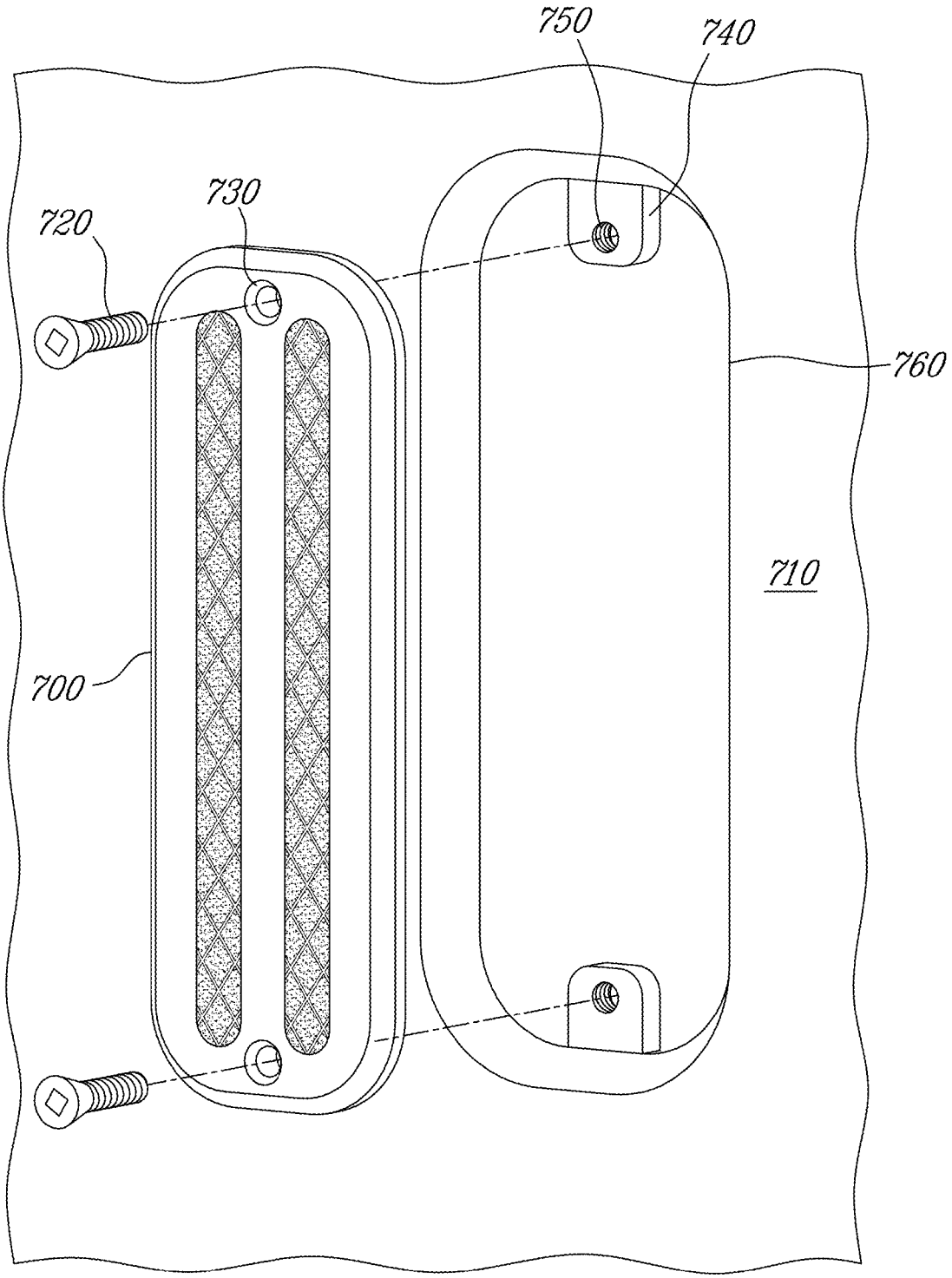
FIG. 7 is a perspective view of an exemplary mesh assembly in accordance with the teachings of the present invention.
Figure 8A:
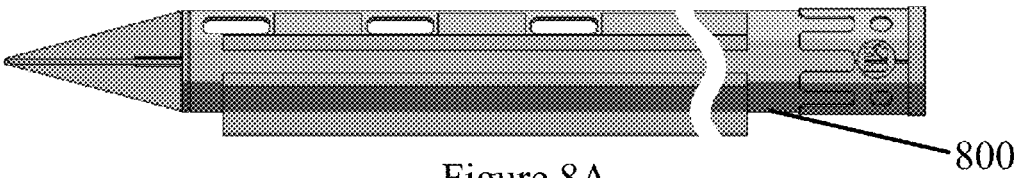
FIG. 8A, FIG. 8B, FIG. 8C, FIG. 8D and FIG. 8E concurrently referred to as FIG. 8, are views diagram of exemplary liquid-controlling slide rails (i.e., one embodiment of the apparatus shown on other figures) in accordance with the teachings of the present invention.
Figure 8B:
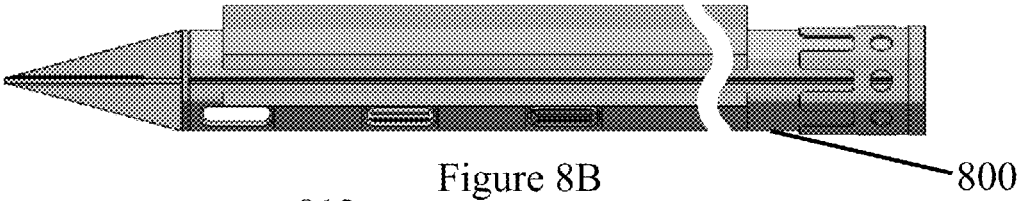
Figure 8C:
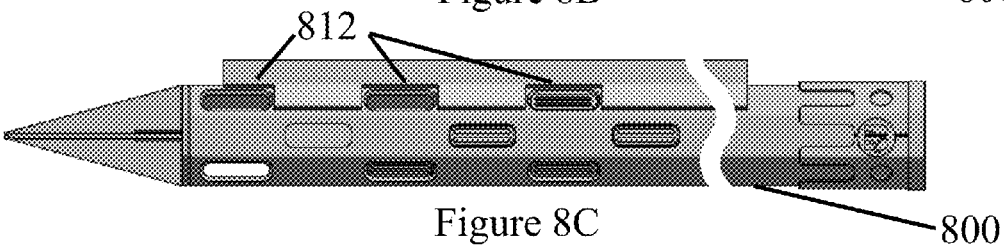
Figure 8D:
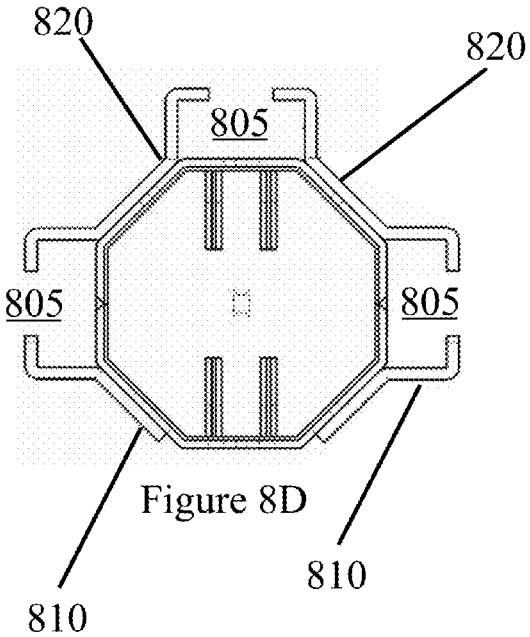
Figure 8E:
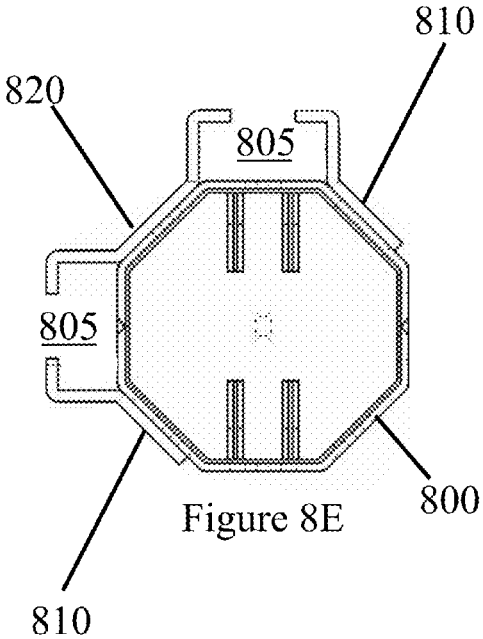
Figure 9:
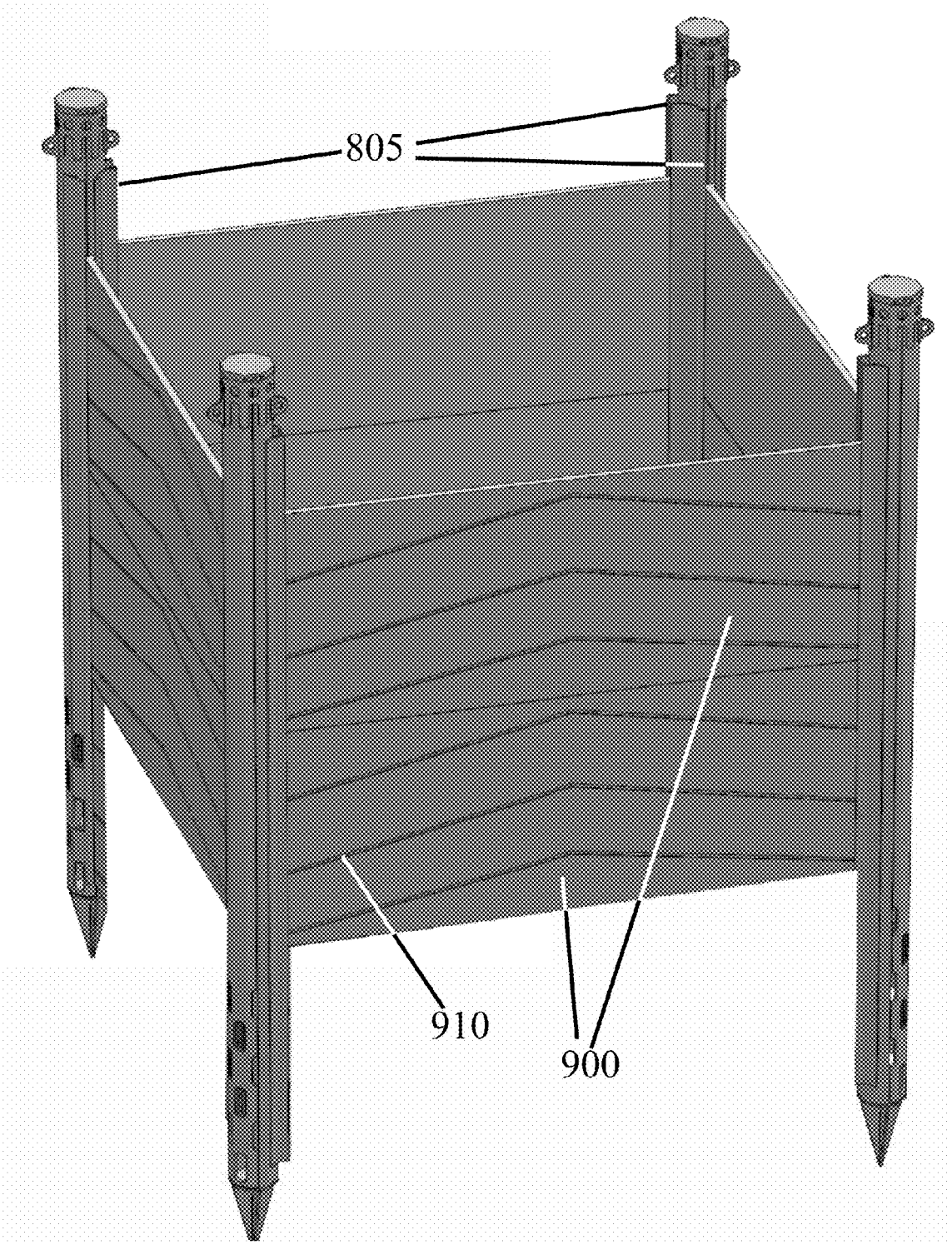
FIG. 9 is a perspective view of an exemplary shoring system comprising liquid-controlling slide rails (i.e., one embodiment of the apparatus shown on other figures) in accordance with the teachings of the present invention.
Figure 10:
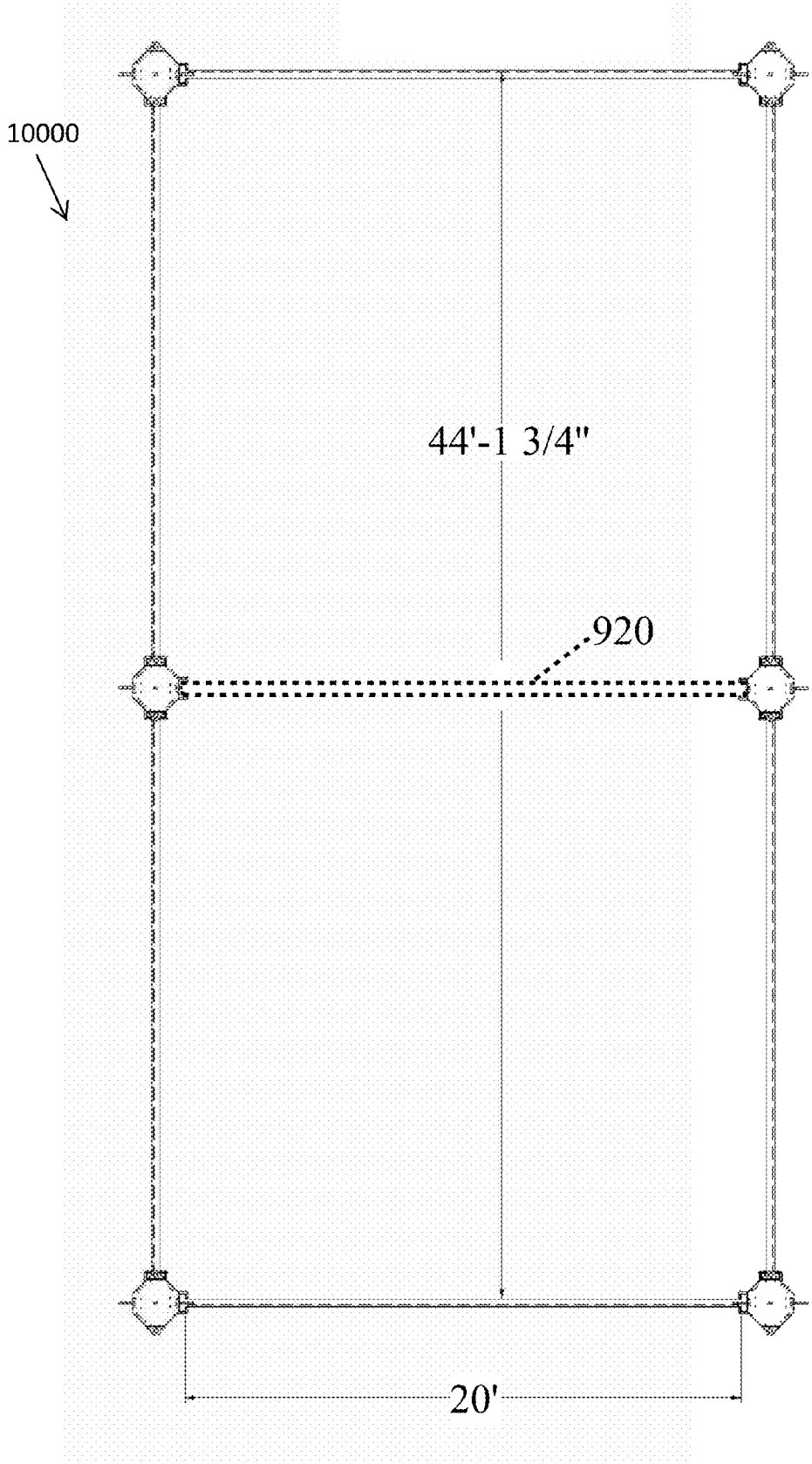
Figure 11:
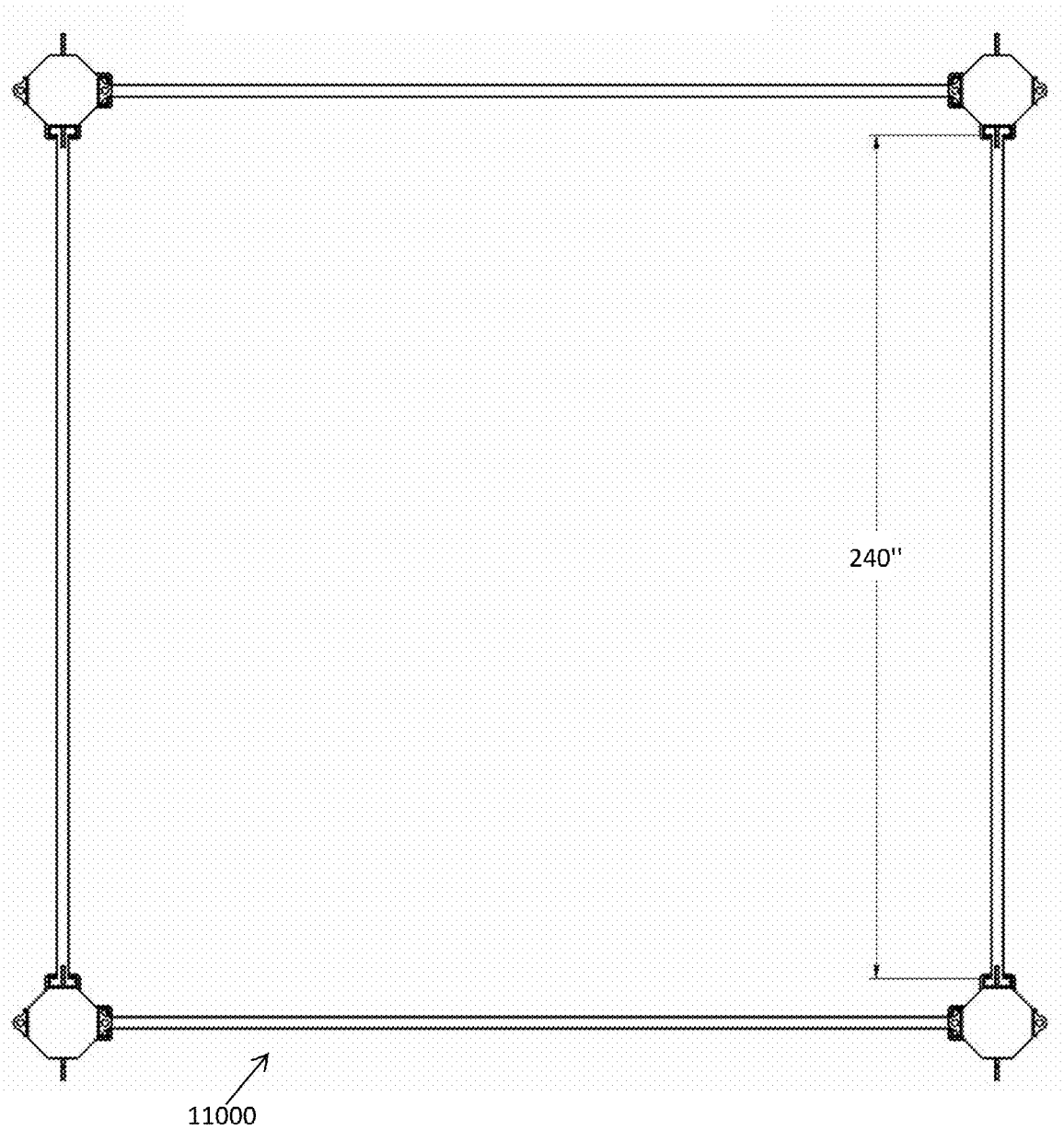
FIG. 11 is a second top view of an exemplary shoring system comprising liquid-controlling slide rails (i.e., one embodiment of the apparatus shown on other figures) in accordance with the teachings of the present invention.
Figure 12:
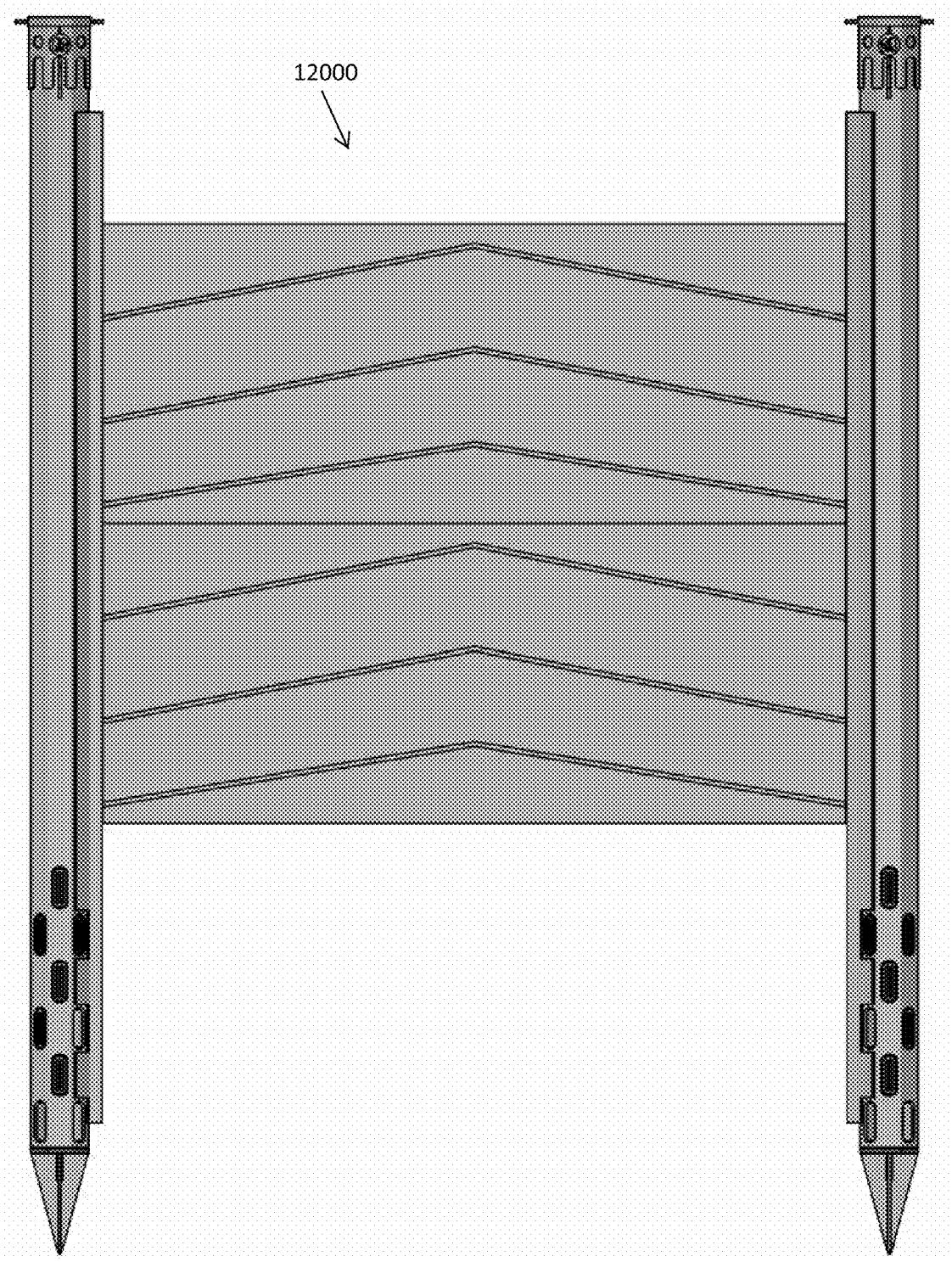
FIG. 12 is a lateral view of an exemplary shoring system comprising liquid-controlling slide rails (i.e., one embodiment of the apparatus shown on other figures) in accordance with the teachings of the present invention.

FIG. 7 shows a perspective view of an embodiment of a mesh construction 700 for installing onto an apparatus for controlling liquid level on a site where a bolt attachment 720 is shown. In this example, the mesh construction 700 is attached to a hollow stake body 710 using a bolt attachment 720. The bolt attachment 720 is then further inserted into an attachment point 750 of an attachment support 740. The attachment support 740 may be found on the hollow stake body 120 around the ridges of a spacing 760 for receiving the mesh construction 700. The attachment support 740 may be protruding inwardly on the ridges of the spacing 760 for not hindering the insertion of the mesh construction 700 into the spacing 760. In a preferred embodiment, the bolt attachment 720 may be a tapered flat head screw in order for the bolt not to protrude (or to arrive flush) with the mesh construction 700 when fully inserted into a mesh construction tapered hole 730. Skilled persons will notice that the bolt attachment 720 may be of other types than a tapered flat head screw without diverging from the teachings of the present invention. In a preferred embodiment, two bolt attachments 720 are used to attach the mesh construction 700 to the hollow stake body 710, passing through two tapered holes 730 for receiving one of the two bolt attachments 720 respectively, and two attachment supports 740 are used for receiving the bolt attachments 720, where the tapered holes 730 and the attachments supports 740 are placed longitudinally at opposite ends of one another.

Some embodiments may provide one or more than two bolt attachments 720, tapered holes 730 and attachment supports 740. Additionally, in some embodiments, the number of attachment supports 740 may be greater than the number of bolt attachments 720, where the additional attachment supports 740 are for solidifying and offering additional support to the mesh construction 700 when inserted into the spacing on the hollow stake body 710. Additionally, skilled persons will recognize that the number of bolt attachments 720, attachment supports 740 and the location of the bolt attachments 720 and attachment supports 740 may vary depending on size, weight and required tension of the mesh construction 700 when inserted into the spacing 760 of the hollow stake body 710. As skilled person will readily appreciate the size of the different components 720-750 may differ without affecting the described functionality. Other types of attachment mechanisms (e.g., nuts and bolts, snap on, press fit, etc.) may also be used to maintain the mesh construction 700 into the hollow stake body 710 while sustaining the expected pressure from its intended use.

In some embodiments, the bolt attachments, as the bolt attachments are inserted into the tapered holes and subsequently into the attachment point of the attachment support, may also attach the mesh assembly to the first punctured cover and the second punctured cover without the need for welding, where the number of bolt attachments may vary for increasing the solidity of the attachment between the mesh assembly, the first punctured cover and the second punctured cover.

The mesh construction 700 may also comprise a sealing frame (not shown), covering the complete perimeter of the spacing 760, positioned within the hollow stake body 710 to support the mesh construction 700 once the mesh construction 700 is inserted into the spacing 760. The sealing frame may be used for preventing infiltration of liquid into the apparatus through the gap between the mesh construction 700 and the hollow stake body 710 once the mesh construction 700 is bolted to the hollow stake body 710, enhancing the seal between the mesh construction 700 and the hollow stake body 710. The shape, thickness and width of the sealing frame may vary in order to accommodate different forms of mesh constructions. The shape of the mesh construction may be different from the shape of the spacing in the hollow stake body, where the sealing frame compensates for these differences in shape and seals the gap and preventing liquid infiltration. The sealing frame may be provided as a plate soldered from within the hollow stake body 710. The shape of the plate may be different that the spacing 760. The shape of the plate may also be provided to avoid interference with the filtration mesh (e.g., not positioned over opened portions of the mesh construction). In a preferred embodiment, the sealing frame is made of steel. However, skilled persons will recognize that the sealing frame may be made of other materials without departing from the teachings of the present invention.

In a preferred embodiment, the sealing frame further provides a rubber seal. A rubber may also (alternatively or in addition) be provided with the mesh construction. For instance, the rubber seal may be provided between the first punctured cover and the second punctured, around the filtration mesh. When the mesh construction is assembled with bolts, the rubber seal may be further shaped so as to protrude under the compression force exerted during assembly of the mesh construction and/or during installation of the mesh construction in the spacing 760 using the bolt attachment 720.

The mesh assembly may further comprise a protective mesh over the filtration mesh and the first punctured cover, the first punctured cover being outwardly positioned when the apparatus is underground at the site. The protective mesh is for preventing foreign bodies from piercing or damaging the mesh and deflecting these foreign bodies when the apparatus is in the ground. A preferred embodiment provides a filtration mesh which is a grille. However, skilled persons will notice that the filtration mesh may be instead a framework of metal bars, a hard cover punctured with large gaps or any other means of protecting the mesh while allowing liquid and/or air to flow through, into the mesh and into a hollow stake body, without departing from the teachings of the present invention. In a preferred embodiment, the first punctured cover is thicker than the second punctured cover.

The mesh construction may also provide the first punctured cover with elongated apertures along a longitudinal axis of the apparatus for protecting the mesh assembly when the apparatus is being put into the ground. The elongated apertures offer an initial barrier for foreign bodies (e.g. wood, rocks and sticks) while allowing liquid to flow through.

In certain embodiments, there is provided an exemplary shoring system for shoring an excavation site, or the like, comprising a plurality slide rails with at least one of liquid-controlling slide rail 800, each liquid-controlling slide rail 800 comprising a hollow body and lateral openings permeable to liquid (e.g., allowing water or air in and out) when the slide rail is positioned into the ground, the openings being positioned on at least a portion of the liquid-controlling slide rail 800 directed outside of the excavation site (e.g., allowing water in the hollow body for extraction, but not in the excavation through the hollow body). Persons skilled in the art will readily recognized that the liquid-controlling slide rail 800 may be built and/or installed in accordance with the teachings previously discussed in relation to the apparatus 100 and its related features as illustrated in FIGS. 1 to 7. An excavation site may comprise a site where an excavation is to take place, a site where excavation has taken place already and needs to be protected (e.g., for security reasons or for further excavation) and/or a site to be at least partially infilled and/or flooded.

The shoring system may comprise conventional rails(s) (not shown) as well as liquid-controlling slide rail(s) 800. Each liquid-controlling slide rail 800 may comprise a stake tip at one end of the hollow body for facilitating insertion of the liquid-controlling slide rail 800 into the ground, as depicted in the example. Each of the slide rails comprises at least two plate rails. FIG. 8 depicts exemplary plate rails 805 of the liquid-controlling slide rail 800. The system also comprises a plurality of lateral plates 900, each plate being slidable into the plate rails 805 of two adjacent slide rails.

The system may also comprise intermediate beams 920 positioned between opposite slide rails when more than four slide rails are present in the system.

One or more of the plates 900 may comprise one or more surface gutters 910 on at least their outside face for facilitating water drainage by gravity, e.g., towards one or two of the liquid-controlling slide rails 800 in which it is inserted.

The system may also be used, for instance, for excavation into underwater ground, for controlling rising water (e.g. preventing flooding), for better controlling spills (e.g., preventing oil from a spill to reach coasts, etc.

Liquid-controlling slide rails 800 may present two (e.g., for corner slide rails) or three (e.g., for intermediate sides slide rails) plate rails 805. Each corner plate rail may be formed by an external steel plate 810 and an internal steel plate 820, e.g. soldered onto the exterior of the hollow body. Intermediate plate rail (i.e., center plate rail when there are three plate rails) may be formed by two internal steel plates 820 soldered onto the exterior of the hollow body. In some embodiments, external steel plates 810 may have one or more carved out sections 812 to avoid blocking at least some of the openings in the hollow body. In some embodiments, internal steel plates 820 intentionally block at least some of the openings in the hollow body, if ever present thereunder. The internal steel plates 820 may also be positioned over a joint of the hollow body, which may simplify manufacturing of a two-piece hollow body (e.g., avoiding the cut of the openings) and may also increase strength to the soldering by allowing additional weldable surfaces (e.g., circular cutouts) in the internal steel plates 820 towards the hollow body. One or more hooks (not shown) may be provided along the length of the hollow body, e.g., to allow for easier extraction of the liquid-controlling slide rail 800 from the ground.

FIGS. 9 to 12 present different exemplary configurations 10000, 11000 and 12000 of systems presenting at least one liquid-controlling slide rails 800. In some embodiments, the conventional slide rails (not shown) and liquid-controlling slide rails 800 are interchangeable.

The description of the present invention has been presented for purposes of illustration but is not intended to be exhaustive or limited to the disclosed embodiments. Many modifications and variations will be apparent to those of ordinary skill in the art. Elements in the drawings are not necessarily drawn to scale. The embodiments were chosen to explain the principles of the invention and its practical applications and to enable others of ordinary skill in the art to understand the invention in order to implement various embodiments with various modifications as might be suited to other contemplated uses.

What is claimed is:

1. A shoring system for controlling liquid on an excavation site comprising:

at least four slide rails positioned at different vertices of the shoring system at the excavation site, the at least four slide rails comprising at least one liquid-controlling slide rail comprising a hollow body and lateral openings permeable to liquid when the at least one liquid-controlling slide rail is positioned into the ground at one of the different vertices, the openings being positioned on at least a portion of the liquid-controlling slide rail directed outside of the shoring system, wherein each of the plurality of slide rails comprise at least two plate rails; and a plurality of lateral plates, each plate being slidable into the plate rails of two slide rails of the at least four slide rails positioned at two adjacent vertices of the shoring system;

wherein the shoring system, positioned at the excavation site, allows excavation to be performed within the shoring system next to one or more of the plurality of lateral plates to a base level below a topmost of the plurality of lateral plates.

2. The shoring system of claim 1, wherein the at least one liquid-controlling slide rail comprises a stake tip at one end of the hollow body for facilitating positioning of the liquid-controlling slide rail at the excavation site and a hit plate receiver at an opposite end of the hollow stake body.

3. The shoring system of claim 1 comprising one or more intermediate beams positioned between opposite slide rails positioned at opposite vertices of the shoring system when more than four slide rails are present in the system.

4. A shoring system for controlling liquid on an excavation site comprising:

at least four slide rails positioned at different vertices of the shoring system at the excavation site, the at least four slide rails comprising at least one liquid-controlling slide rail comprising a hollow body and lateral openings permeable to liquid when the at least one liquid-controlling slide rail is positioned into the ground, the openings being positioned on at least a portion of the liquid-controlling slide rail directed outside of the excavation site, wherein each of the plurality of slide rails comprise at least two plate rails; and a plurality of lateral plates, each plate being slidable into the plate rails of two slide rails of the at least four slide rails positioned at two adjacent vertices of the shoring system, wherein one or more of the lateral plates comprises one or more surface gutters at least on an outside face thereof for facilitating water drainage by gravity.

5. The shoring system of claim 1, wherein the at least one liquid-controlling slide rails comprises a first plate rail and a second plate rail positioned at an angle between substantially 90 and 120 degrees from one another.

6. The shoring system of claim 5, wherein each of the two plate rails comprises a first exterior steel plate onto an exterior surface of the hollow body directed outside of the shoring system and a second internal steel plate soldered onto an exterior surface of the hollow body directed inside of the shoring system.

7. The shoring system of claim 6, wherein the external steel plates each provide at least one carved out section to avoid blocking at least some of the openings thereunder in the hollow body and the internal steel plates each intentionally block at least some of the openings thereunder in the hollow body.

8. The shoring system of claim 5, wherein the at least one liquid-controlling slide rail comprises a third plate rail positioned at substantially 180 degrees from the first plate rail.

9. The shoring system of claim 8, wherein the first and the third of the plate rails positioned at 180 degrees from one another each comprise a first external steel plate onto the exterior of the hollow body directed outside of the excavation and a second internal steel plate soldered onto the exterior of the hollow body directed inside of the excavation and wherein the second of the plate rails comprise two internal steel plates soldered onto the exterior of the hollow body directed inside of the shoring system.

10. The shoring system of claim 9, wherein the external steel plates each provide at least one carved out section to avoid blocking at least some of the openings thereunder in the hollow body and the internal steel plates each intentionally block at least some of the openings thereunder in the hollow body.

11. The shoring system of claim 1, wherein the openings are over only a longitudinal portion of the hollow body defined from a central angle directed outside of the shoring system.

12. The shoring system of claim 1, wherein the openings are over only a lateral portion of the hollow body.

13. The shoring system of claim 1, further comprising one or more pump for extracting water from the at least one liquid-controlling slide rails.

14. The shoring system of claim 1, wherein the plurality of slide rails comprises at least one conventional slide rail, that does not comprise lateral openings permeable to liquid and does not comprise a hollow structure for receiving the liquid, together with the at least one liquid-controlling slide rail.

15. The shoring system of claim 1, wherein the at least one liquid-controlling slide rail comprises a hit plate receiver and a hit plate, removably positioned over the hit plate receiver, for receiving repeated hits, the hit plate being adapted to transfer force exerted thereon by the repeated hits to the hollow stake body for forcing the at least one liquid-controlling slide rail into the ground at the excavation site wherein, once the hit place is removed, the hollow stake body allows for liquid possibly accumulated in the hollow stake body to be pumped out.

16. The shoring system of claim 15, wherein the hollow stake body is shaped as a polygonal prism and the hit plate receiver at least partially cover bends in the hollow stake body along edges of the polygonal prism.

17. The shoring system of claim 16, wherein each of the plurality of lateral openings are interspersed on one or more of the polygonal prism faces for limiting stress formation along the hollow stake body.

18. The shoring system of claim 1, further comprising a mesh construction over at least one of the openings in the hollow body, wherein the mesh construction comprises:

a first punctured cover;

a second punctured cover; and a mesh assembly, comprising at least one filtration mesh, sandwiched between the first punctured cover and the second punctured cover permeable to liquid when the mesh construction is installed over the at least one opening.

19. The shoring system of claim 18, wherein the mesh assembly further comprises a protective mesh over the infiltration mesh and the first punctured cover, the first punctured cover being directed outside of the excavation.

20. The shoring system of claim 18, wherein the first punctured cover comprises elongated apertures along a longitudinal axis of the hollow body for protecting the mesh assembly when the at least one liquid-controlling slide rail is being installed at the excavation site.

21. The shoring system of claim 2, wherein the hollow stake body is of at least 71"¾ in length and has an internal width of at least 16"31/32.

* * * * *